US008884860B2

(12) United States Patent
Lee et al.

(10) Patent No.: US 8,884,860 B2
(45) Date of Patent: Nov. 11, 2014

(54) LIQUID CRYSTAL DISPLAY HAVING INCREASED RESPONSE SPEED, AND DEVICE AND METHOD FOR MODIFYING IMAGE SIGNAL TO PROVIDE INCREASED RESPONSE SPEED

(75) Inventors: Woo-Young Lee, Daegu (KR); Jae-Won Jeong, Seoul (KR); Woo-Jin Jung, Seoul (KR); Kang-Hyun Kim, Seoul (KR); Duc-Han Cho, Incheon (KR); Su-Bin Park, Incheon (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 548 days.

(21) Appl. No.: 13/180,981

(22) Filed: Jul. 12, 2011

(65) Prior Publication Data

US 2012/0194567 A1 Aug. 2, 2012

(30) Foreign Application Priority Data

Feb. 1, 2011 (KR) ..... 10-2011-0010213

(51) Int. Cl.
*G09G 3/36* (2006.01)

(52) U.S. Cl.
CPC ..... *G09G 3/3648* (2013.01); *G09G 3/3614* (2013.01); *G09G 2320/0252* (2013.01); *G09G 2340/16* (2013.01)
USPC ..... 345/89

(58) Field of Classification Search
CPC .. G09G 3/3648; G09G 3/2011; G09G 3/3688
USPC ..... 345/89, 211, 690
See application file for complete search history.

(56) References Cited

U.S. PATENT DOCUMENTS 7,042,247 B1 * 5/2006 Pedersen ..... 326/38
7,633,475 B2 12/2009 Park (Continued)

FOREIGN PATENT DOCUMENTS

JP 2004-252103 9/2004
JP 2006-019899 1/2006

(Continued)

OTHER PUBLICATIONS

English Abstract for Publication No. 2004-252103.

(Continued)

*Primary Examiner* — Chanh Nguyen
*Assistant Examiner* — Jonathan Blancha
(74) *Attorney, Agent, or Firm* — F. Chau & Associates, LCC

(57) ABSTRACT

A liquid crystal display includes an image signal modifier for generating a modified signal based on a first image signal of a first frame, a second image signal of a second frame, and a lookup table. A data driver converts the modified signal into a data voltage which is supplied to a pixel of the display. The lookup table stores a plurality of reference modified signals for a plurality of reference first image signals and a plurality of reference second image signals. The lookup table includes a first lookup table having a gray gap of the reference first image signals and a gray gap of the reference second image signals of x, and a second lookup table having a gray gap of the reference first image signals and a gray gap of the reference second image signals of y, where y is greater than x.

15 Claims, 11 Drawing Sheets

(56) References Cited

U.S. PATENT DOCUMENTS

| | | | | |
|---|---|---|---|---|
| 7,679,619 | B2 | 3/2010 | Ooga et al. | |
| 2004/0263495 | A1* | 12/2004 | Sugino et al. | 345/204 |
| 2006/0044618 | A1* | 3/2006 | Mizoguchi | 358/3.23 |
| 2007/0176878 | A1 | 8/2007 | Lee | |
| 2009/0109247 | A1* | 4/2009 | Kimura | 345/690 |
| 2010/0156951 | A1* | 6/2010 | Park et al. | 345/690 |

FOREIGN PATENT DOCUMENTS

| | | |
|---|---|---|
| JP | 2007-249085 | 9/2007 |
| JP | 2009-162944 | 7/2009 |
| JP | 4438997 | 1/2010 |
| JP | 2010-128497 | 6/2010 |
| KR | 1020060027767 | 3/2006 |
| KR | 1020070078551 | 8/2007 |

OTHER PUBLICATIONS

English Abstract for Publication No. 2006-019899.
English Abstract for Publication No. 1020060027767.
English Abstract for Publication No. 1020070078551.
English Abstract for Publication No. 2007-249085.
English Abstract for Publication No. 2009-162944.
English Abstract for Publication No. 4438997.
English Abstract for Publication No. 2010-128497.

* cited by examiner

LIQUID CRYSTAL DISPLAY HAVING INCREASED RESPONSE SPEED, AND DEVICE AND METHOD FOR MODIFYING IMAGE SIGNAL TO PROVIDE INCREASED RESPONSE SPEED

CROSS-REFERENCE TO RELATED APPLICATION

This application claims priority to Korean Patent Application No. 10-2011-0010213 filed in the Korean Intellectual Property Office on Feb. 1, 2011, the entire contents of which are incorporated herein by reference.

BACKGROUND OF THE INVENTION (a) Technical Field

The present invention relates to a liquid crystal display, and more particularly, to a liquid crystal display, an image signal modifying device, and an image signal modifying method.

(b) Description of the Related Art

A liquid crystal display (hereinafter referred to as an LCD) is one of the most widely used flat panel displays. LCD's generally include two display panels with a liquid crystal layer interposed therebetween. Electric field generating electrodes, such as pixel electrodes and a common electrode, are provided within the display panels. In the LCD, voltages are applied to the electric field generating electrodes to generate an electric field in the liquid crystal layer. Due to the generated electric field, liquid crystal molecules of the liquid crystal layer are aligned and polarization of incident light is controlled, thereby displaying images.

In general, the liquid crystal display includes a matrix of pixels each including a switching element realized with a thin film transistor (TFT). The LCD further includes a three terminal element and a display panel including display signal lines, i.e., a gate line and a data line. The thin film transistor functions as a switching element for transmitting a data voltage that is transmitted through the data line to a pixel or intercepting the pixel according to a gate signal that is transmitted through the gate line.

The liquid crystal capacitor has a pixel electrode and a common electrode as terminals and a liquid crystal layer between the electrodes functions as a dielectric material. A difference between a data voltage applied to the pixel electrode and a common voltage applied to the common electrode is referred to as a charged voltage of the liquid crystal capacitor, which is a pixel voltage. The arrangement of the liquid crystal molecules of the liquid crystal layer is changed according to the pixel voltage and in that way polarization of light passing through the liquid crystal layer is varied. The LCD additionally includes a polarizer for polarizing incident light. Accordingly, as the liquid crystal molecules change arrangement due to the applied electric field, the amount of polarized incident light that can transmit through the liquid crystal layer is affected. In this way, each pixel is able to provide a desired luminance, or gray level, in accordance with an image signal, by setting the pixel voltage.

However, since the response speed of the liquid crystal molecules is slow, it can take some time for the pixel voltage of the liquid crystal capacitor to reach a target voltage, which is a voltage used to acquire desired luminance. The length of time required for the liquid crystal capacitor to reach the pixel voltage is influenced by a difference between the voltage previously charged in the liquid crystal capacitor and the current target voltage. Accordingly, when the difference between the target voltage and the previous voltage is large, for example, when there has been no previous voltage applied, the liquid crystal capacitor may not reach the target voltage while the switching element is turned on.

Dynamic capacitance compensation (DCC) is a scheme in which the response speed of the liquid crystal is increased according to a driving method without changing the properties of the liquid crystal. DCC relies on the fact that the charging rate increases as the voltage at the liquid crystal capacitor becomes greater, and accordingly, the time required for the voltage in the liquid crystal capacitor to reach the target voltage is reduced by controlling the data voltage applied to the corresponding pixel to be greater than the target voltage. Where the common voltage is not zero, it is not necessarily the data voltage that is greater than the target voltage, but the difference between the data voltage and the common voltage that is greater than zero. However, for simplicity, it may be assumed that the common voltage is zero.

However, the drive frequency of the liquid crystal display is gradually increased, and as the drive rate of the liquid crystal display is increased, the time available to charge the liquid crystal capacitor is reduced. Therefore, the conventional DCC scheme may bring about degradation of image quality of the liquid crystal display, especially at high driving frequencies.

SUMMARY OF THE INVENTION

An exemplary embodiment of the present invention provides a liquid crystal display including a pixel, an image signal modifier for generating a modified signal based on a first image signal of a first frame, a second image signal of a second frame, and a lookup table. The LCD further includes a data driver for converting the modified signal into a data voltage and supplying the same to the pixel. The lookup table stores a plurality of reference modified signals corresponding to a plurality of reference first image signals and a plurality of reference second image signals. The lookup table includes a first lookup table having a gray gap of the reference first image signals and a gray gap of the reference second image signals of x (where x is a natural number), and a second lookup table having a gray gap of the reference first image signals and a gray gap of the reference second image signals of y (where y is a natural number greater than x). As used herein, a gray gap is the difference between two gray levels.

A gray level of the reference first image signals is less than N (where N is a natural number) in the first lookup table, and a gray level of the reference first image signals is greater than N in the second lookup table.

When the gray level of the first image signal is less than N, the image signal modifier generates the modified signal based on the first lookup table.

When the gray level of the first image signal does not correspond to the gray level of the reference first image signals or the gray level of the second image signal does not correspond to the gray level of the reference second image signals, the image signal modifier generates the modified signal by interpolating the lookup table.

N may be 16, x may be greater than 3, and y may be greater than 16.

Regarding the first lookup table, the gray level of the reference first image signals may be from gray 0 to gray 16, the gray level of the reference second image signals may be from gray 0 to gray 255, and gray gaps of the reference first image signals and the reference second image signals may be 3 or 4. Regarding the second lookup table, the gray level of the reference first image signals may be from gray 32 to gray 255, the gray level of the reference second image signals may be from gray 32 to gray 255, and gray gaps of the reference first image signals and the reference second image signals may be 31 or 32.

The first lookup table may store 5*64 (320) reference modified signals for the 5 reference first image signals and the 64 reference second image signals. The second lookup table may store 8*8 (64) reference modified signals for the 8 reference first image signals and the 8 reference second image signals.

The liquid crystal display may further include a frame memory for storing and/or outputting the first image signal and the second image signal.

The first frame and the second frame may be continuous, and the second frame may come after the first frame.

The dynamic capacitance compensation (DCC) method is applied to the lookup table.

An embodiment of the present invention provides a method for modifying an image signal of a liquid crystal display including receiving a first image signal and a second image signal of two continuous frames. A modified signal is generated based on the first image signal, the second image signal, and the lookup table. The modified signal is converted into a data voltage and the data voltage is supplied to a pixel. The lookup table stores a plurality of reference modified signals for a plurality of reference first image signals and a plurality of reference second image signals. The lookup table includes a first lookup table having a gray gap of the reference first image signals and a gray gap of the reference second image signals of x (where x is a natural number), and a second lookup table having a gray gap of the reference first image signals and a gray gap of the reference second image signals of y (where y is a natural number greater than x).

The generating of a modified signal may include determining whether the gray level of the first image signal is less than N (where N is a natural number). When the gray level of the first image signal is less than N, the modified signal is generated based on the first lookup table. When the gray level of the first image signal is not less than N, the modified signal is generated based on the second lookup table.

Additionally, when the gray level of the first image signal does not correspond to the gray level of the reference first image signals or the gray level of the second image signal does not correspond to the gray level of the reference second image signals, generating the modified signal by interpolating the lookup table.

N may be 16, x may be greater than 3, and y may be greater than 31.

An embodiment of the present invention provides a device for modifying an image signal of a liquid crystal display, including a lookup table for storing a plurality of reference modified signal for a plurality of reference first image signals and a plurality of reference second image signals. An image signal modifier receives a first image signal of a first frame and a second image signal of a second frame coming after the first frame, and generates a modified signal based on the first image signal, the second image signal, and the lookup table. The lookup table includes a first lookup table having a gray gap of the reference first image signals and a gray gap of the reference second image signals of x (where x is a natural number), and a second lookup table having a gray gap of the reference first image signals and a gray gap of the reference second image signals of y (where y is a natural number greater than x).

A gray level of the reference first image signals may be less than N (where N is a natural number) in the first lookup table, and a gray level of the reference first image signals may be greater than N in the second lookup table.

When the gray level of the first image signal is less than N, the image signal modifier generates the modified signal based on the first lookup table.

When the gray level of the first image signal does not correspond to the gray level of the reference first image signals or the gray level of the second image signal does not correspond to the gray level of the reference second image signals, the image signal modifier generates the modified signal by interpolating the lookup table.

The dynamic capacitance compensation (DCC) method may be applied to the lookup table.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

DETAILED DESCRIPTION OF THE EMBODIMENTS

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

An image signal modifying device and an image signal modifying method according to an exemplary embodiment of the present invention will now be described with reference to FIG. 1 and FIG. 2.

Figure 1:
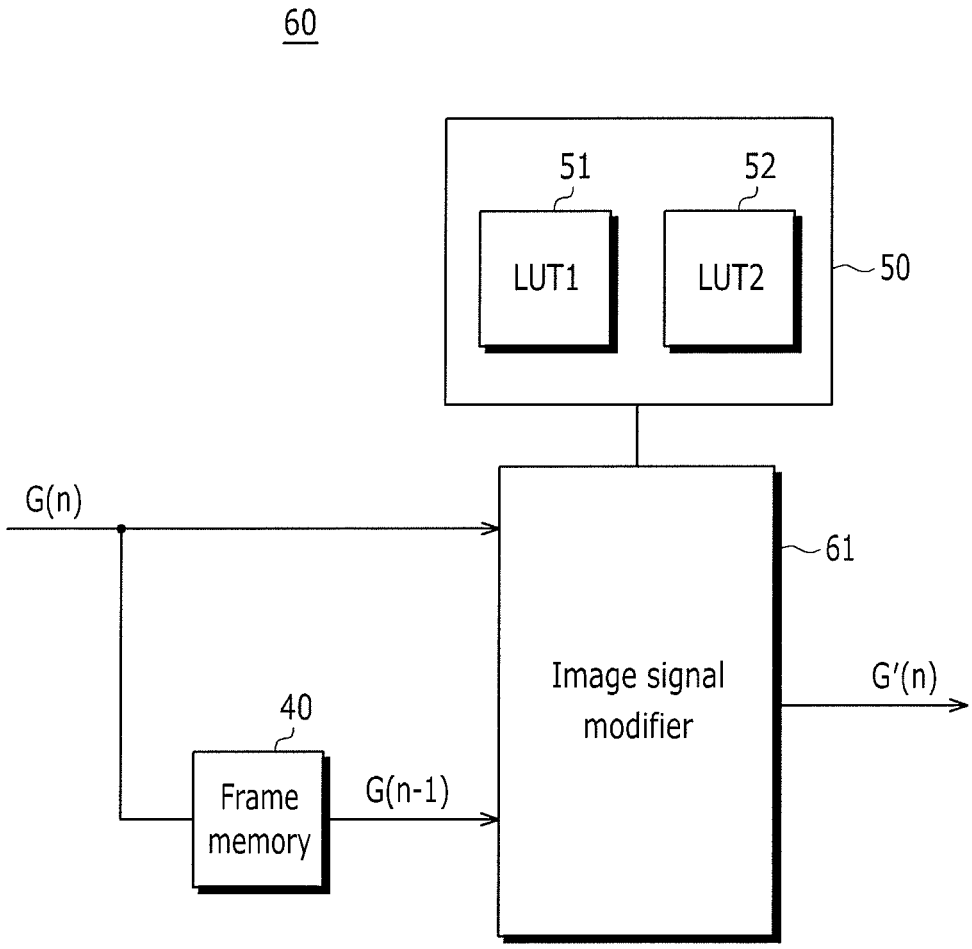
FIG. 1 is a block diagram of an image signal modifying device according to an exemplary embodiment of the present invention.
Figure 2:
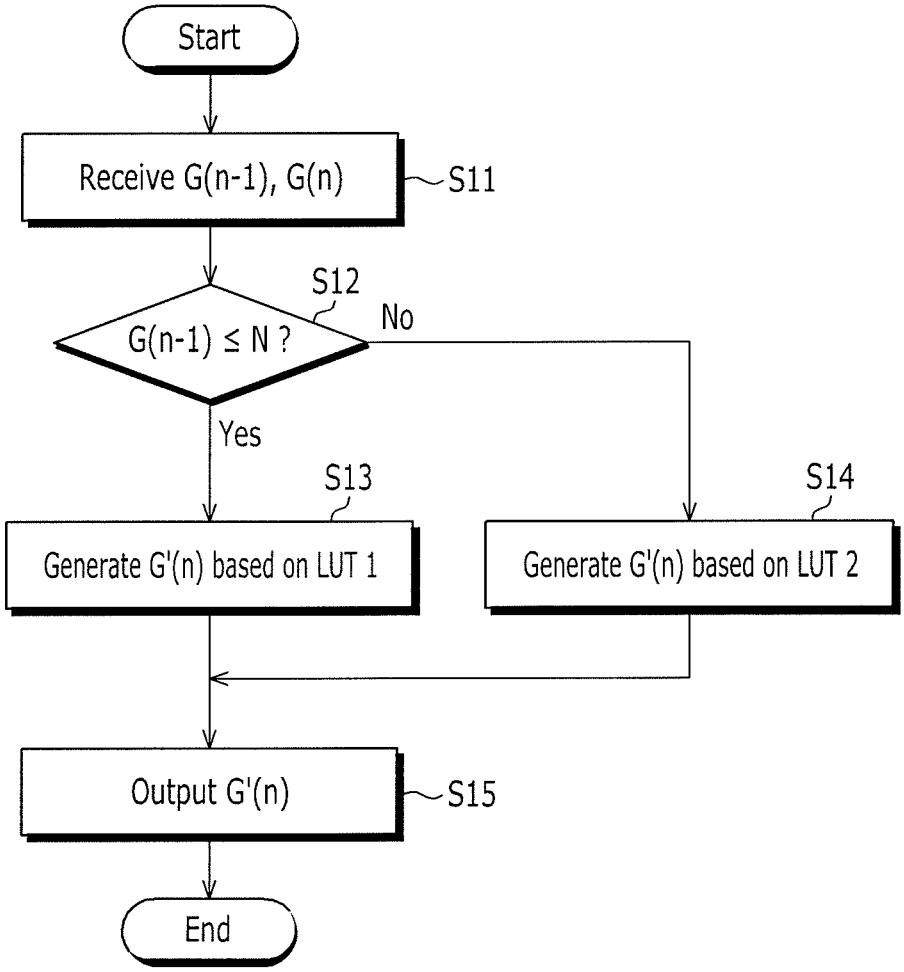
FIG. 2 is a flowchart of an image signal modifying method according to an exemplary embodiment of the present invention.

FIG. 1 shows a block diagram of an image signal modifying device according to an exemplary embodiment of the present invention, and FIG. 2 shows a flowchart of an image signal modifying method according to an exemplary embodiment of the present invention.

Referring to FIG. 1, the image signal modifying device 60 includes a frame memory 40, an image signal modifier 61 connected to the frame memory 40, and a lookup table (LUT) 50 connected to the image signal modifier 61.

For better comprehension and ease of description, an image signal [G(n−1)] of the (n−1)-th frame will be called a previous image signal, and an image signal [G(n)] of the n-th frame will be called a current image signal. The image signals of the frame can be a set of gray levels for all pixels. The gray level is the intensity of a given pixel, and an image signal may communicate color image data by providing gray levels for three subpixels, for each pixel, corresponding to red, green and blue. However, for the purpose of simplicity, the subpixels may be referred to herein simply as pixels and in this way, the image signal of the frame can be represented as a set of gray levels for all pixels.

The previous image signal [G(n−1)] can be referred to as a first image signal, and the current image signal [G(n)] can be referred to as a second image signal. The (n−1)-th frame can be called a first frame, and the n-th frame can be called a second frame. The first frame and the second frame are sequential, and accordingly, the second frame immediately follows the first frame, without intervening frames.

The frame memory 40 outputs the stored previous image signal [G(n−1)] to the image signal modifier 61, and receives and stores the current image signal [G(n)].

The image signal modifier 61 modifies the current image signal [G(n)] by using the previous image signal [G(n−1)] received from the frame memory 40, the current image signal received [G(n)] from an external device, and the lookup table 50 to generate a modified signal [G'(n)] and output the same.

The lookup table 50 stores a modified signal [G'(n)] for a pair [G(n−1), G(n)] of the previous image signal and the current image signal. However, the size of the lookup table 50 may be very large in order to store the entire modified signal [G'(n)] for all pairs [G(n−1), G(n)] of the previous image signal and the current image signal in the lookup table 50.

Since the capacity of a memory is limited, the lookup table 50 may store a reference modified signal [rG'(n)] for a limited number of pairs [rG(n−1), rG(n)] of the reference previous image signal and the reference current image signal (hereinafter, a pair of reference image signals). A modified signal [G'(n)] for a pair [G(n−1), G(n)] of the previous image signal and the current image signal that are not stored in the lookup table 50 (hereinafter, a pair of non-reference image signals) is found by interpolation based on the lookup table 50.

The dynamic capacitance compensation (DCC) scheme is applied to the lookup table 50. For example, the reference modified signal [rG'(n)] represents a value that is generated by applying the DCC scheme to the reference current image signal [rG(n)] based on the reference previous image signal [rG(n−1)].

The reference modified signal [rG'(n)] of the lookup table 50 may include stored experimental results. A difference between the reference modified signal [rG'(n)] and the reference previous image signal [rG(n−1)] is generally greater than a difference between the reference current image signal [rG(n)] and the reference previous image signal [rG(n−1)]. However, when the reference current image signal [rG(n)] corresponds to the reference previous image signal [rG(n−1)] or the difference between the reference current image signal [rG(n)] and the reference previous image signal [rG(n−1)] is small, the reference modified signal [rG'(n)] may correspond to the reference current image signal [rG(n)] (for example, it might not be modified).

In order to find the modified signal [G'(n)] for the pair [G(n−1), G(n)] of non-reference image signals, reference modified signals [rG'(n)] for the pair [rG(n−1), rG(n)] of reference image signals that is near the pair [G(n−1), G(n)] of corresponding non-reference image signals are found from the lookup table 50. A modified signal [G'(n)] for the pair [G(n−1), G(n)] of corresponding non-reference image signals based on the reference modified signals [rG'(n)] is found through interpolation.

For example, an image signal, which is a digital signal, is divided into an upper bit and a lower bit, and reference modified signals [rG'(n)] for the pairs [rG(n−1), rG(n)] of the reference image signals with the lower bit of 0 are stored in the lookup table 50. Reference modified signals [rG'(n)] for a pair [G(n−1), G(n)] of random image signals are found based on the upper bit from the lookup table 50, and a modified signal [G'(n)] is calculated by using the lower bit of the pair [G(n−1), G(n)] of image signals and the reference modified signal [rG'(n)] that are found from the lookup table 50.

The lookup table 50 includes a first lookup table (LUT1) 51 and a second lookup table (LUT2) 52. The first lookup table 51 has a gray gap of a plurality of reference previous image signals [rG(n−1)] and a gray gap of a plurality of reference current image signals [rG(n)] of x (where x is a natural number), and the second lookup table 52 has a gray gap of a plurality of reference previous image signals [rG(n−1)] and a gray gap of a plurality of reference current image signals [rG(n)] of y (where y is a natural number) that is greater than x. For example, x is greater than 3 and y is greater than 16.

The first lookup table 51 and the second lookup table 52 can be divided by a specific gray level of the reference previous image signal [rG(n−1)]. For example, the gray level of a plurality of reference previous image signals [rG(n−1)] is less than N (where N is a natural number) in the first lookup table 51, and the gray level of a plurality of reference previous image signals [rG(n−1)] is greater than N in the second lookup table 52. For example, when the gray levels of the image signal are 0 to 255 and the number of gray levels of the image signal is 256, N can be 16.

Table 1 and Table 2 provide examples of the first lookup table 51 and the second lookup table 52. The image signal [G(n−1), G(n)] has 8 bits, and the gray level of the image signal [G(n−1), G(n)] is 0 to 255.

TABLE 1

| | rG(n − 1) | | | | |
|---|---|---|---|---|---|
| rG(n) | 0 | 4 | 8 | 12 | 16 |
| 0 | 0 | 8 | 24 | 28 | 36 |
| 4 | 16 | 16 | 29 | 35 | 43 |
| 8 | 17 | 31 | 32 | 43 | 55 |
| 12 | 24 | 32 | 44 | 48 | 59 |
| 16 | 24 | 39 | 49 | 55 | 64 |
| 20 | 25 | 48 | 64 | 71 | 77 |
| 24 | 25 | 57 | 77 | 81 | 85 |
| 28 | 25 | 60 | 83 | 88 | 94 |
| 32 | 35 | 60 | 83 | 94 | 100 |
| 36 | 56 | 71 | 85 | 100 | 110 |
| 40 | 71 | 81 | 91 | 102 | 112 |
| 44 | 82 | 90 | 98 | 105 | 115 |
| 48 | 95 | 103 | 110 | 116 | 123 |
| 52 | 108 | 113 | 119 | 124 | 129 |
| . | . | . | . | . | . |
| . | . | . | . | . | . |
| . | . | . | . | . | . |
| 184 | 95 | 103 | 110 | 116 | 123 |
| 188 | 108 | 113 | 119 | 124 | 129 |
| 192 | 125 | 132 | 140 | 147 | 154 |
| 196 | 128 | 139 | 151 | 168 | 173 |
| 200 | 255 | 255 | 255 | 255 | 255 |
| 204 | 0 | 8 | 24 | 28 | 30 |
| 208 | 16 | 16 | 29 | 35 | 43 |
| 212 | 17 | 31 | 32 | 43 | 55 |
| 216 | 24 | 32 | 44 | 48 | 59 |

TABLE 1-continued

| | rG(n − 1) | | | | |
|---|---|---|---|---|---|
| rG(n) | 0 | 4 | 8 | 12 | 16 |
| 220 | 24 | 39 | 49 | 55 | 64 |
| 224 | 25 | 48 | 64 | 71 | 77 |
| 228 | 25 | 57 | 77 | 81 | 85 |
| 232 | 25 | 60 | 83 | 88 | 94 |
| 236 | 35 | 60 | 83 | 94 | 100 |
| 240 | 56 | 71 | 85 | 100 | 110 |
| 244 | 71 | 81 | 92 | 102 | 112 |
| 248 | 82 | 90 | 98 | 105 | 115 |
| 252 | 95 | 103 | 110 | 116 | 123 |
| 255 | 108 | 113 | 119 | 124 | 129 |

Referring to Table 1, the gray level of a plurality of reference previous image signals [rG(n−1)] in the first lookup table 51 ranges from gray 0 to gray 16, and the gray level of a plurality of reference current image signals [rG(n)] ranges from gray 0 to gray 255. A plurality of reference previous image signals [rG(n−1)] and a plurality of reference current image signal [rG(n)] have a gray gap of 4. However, the gray gap between the two greatest grays 252 and 255 of the reference current image signal [rG(n)] is 3. The first lookup table 51 stores 5*64 (320) reference modified signals [rG'(n)] for the 5 reference previous image signals [rG(n−1)] and 64 reference current image signals [rG(n)].

TABLE 2

| | rG(n − 1) | | | | | | | |
|---|---|---|---|---|---|---|---|---|
| rG(n) | 32 | 64 | 96 | 128 | 160 | 192 | 224 | 255 |
| 32 | 103 | 113 | 121 | 134 | 142 | 155 | 179 | 203 |
| 64 | 108 | 118 | 126 | 138 | 150 | 158 | 179 | 203 |
| 96 | 113 | 124 | 132 | 144 | 154 | 166 | 179 | 203 |
| 128 | 117 | 128 | 135 | 150 | 162 | 173 | 186 | 203 |
| 160 | 122 | 133 | 140 | 155 | 166 | 177 | 189 | 203 |
| 192 | 128 | 139 | 148 | 163 | 172 | 182 | 192 | 208 |
| 224 | 133 | 144 | 153 | 165 | 176 | 186 | 197 | 211 |
| 255 | 117 | 128 | 135 | 150 | 162 | 173 | 186 | 203 |

Referring to Table 2, in the second lookup table 52, the gray levels of a plurality of reference previous image signals [rG(n−1)] are gray 32 to gray 255, and the gray levels of a plurality of reference current image signals [rG(n)] are gray 32 to gray 255. The gray gap between the reference previous image signals [rG(n−1)] and the reference current image signals [rG(n)] is 32. However, the gray gap between the two greatest grays 224 and 255 of the reference image signals [rG(n−1), rG(n)] is 31. The second lookup table 52 stores 8*8 (64) reference modified signals [rG'(n)] for the 8 reference previous image signals [rG(n−1)] and the 8 reference current image signals [rG(n)].

A method by which the image signal modifying device 60 of FIG. 1 modifies an image signal will now be described with reference to FIG. 2.

Referring to FIG. 2, the image signal modifying device receives a previous image signal [G(n−1)] and a current image signal [G(n)] (Step S11). The image signal modifying device determines whether a gray level of the previous image signal [G(n−1)] is less than N (Step S12).

When the gray level of the previous image signal [G(n−1)] is less than N (Yes, S12), the image signal modifying device generates a modified signal [G'(n)] based on the first lookup table LUT1 (Step S13).

When the gray level of the previous image signal [G(n−1)] is not less than N (No, S12), the image signal modifying device generates a modified signal [G'(n)] based on the second lookup table LUT2 (Step S14).

The image signal modifying device outputs the generated modified signal [G'(n)] (Step S15).

Accordingly, lookup tables with different gray gaps with reference to a specific gray level (N) of the previous image signal [G(n−1)] can be used. When the gray level of the previous image signal [G(n−1)] is a low gray level that is less than the specific gray level (N), the first lookup table with substantial gray gaps is applied. When the gray of the previous image signal [G(n−1)] is greater than the specific gray level (N), the second lookup table with the gray gap that is greater than that of the first lookup table is applied. The image signal modifying device generates a modified signal [G'(n)] based on the previous image signal [G(n−1)], the current image signal [G(n)], the first lookup table, and the second lookup table. FIG. 1 shows the image signal modifying device 60, which can be included in the liquid crystal display. The modified signal [G'(n)] increases the response speed of the liquid crystal and prevents problems on the screen.

Figure 3:
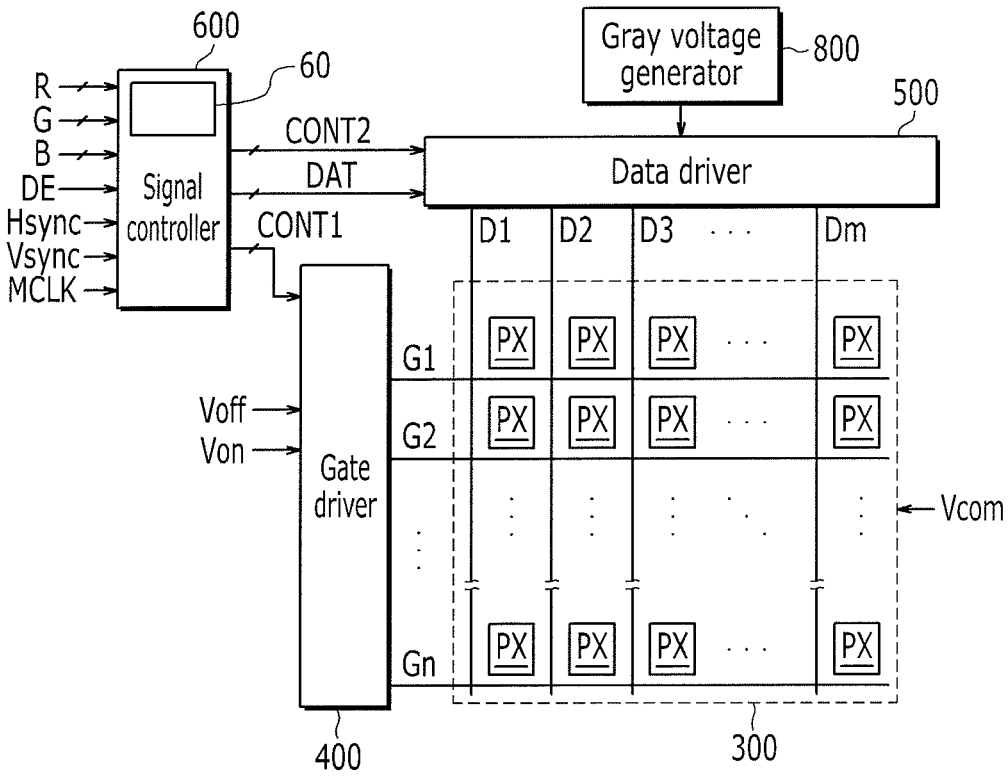
FIG. 3 is a block diagram of a liquid crystal display according to an exemplary embodiment of the present invention.
Figure 4:
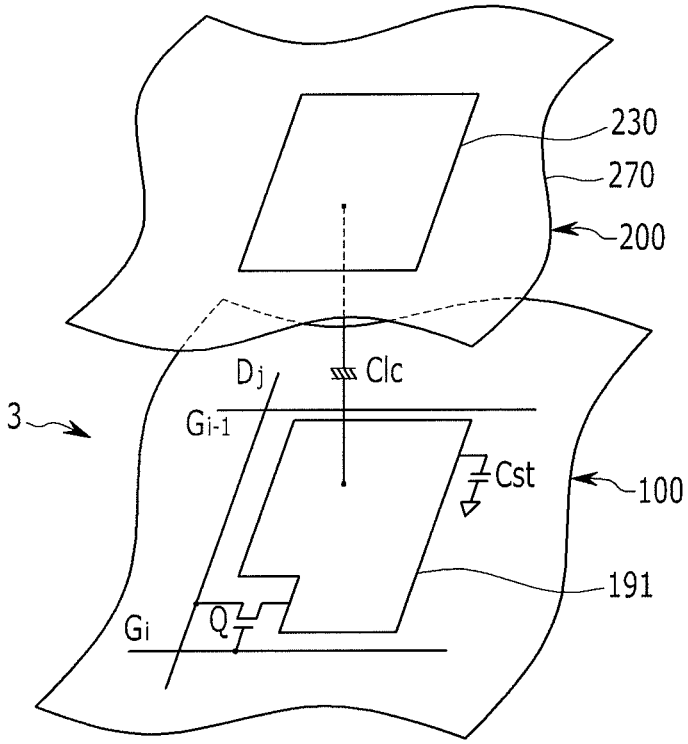
FIG. 4 is an equivalent circuit diagram of a pixel in a liquid crystal display according to an exemplary embodiment of the present invention.

FIG. 3 shows a block diagram of a liquid crystal display according to an exemplary embodiment of the present invention, and FIG. 4 shows an equivalent circuit diagram of a pixel in a liquid crystal display according to an exemplary embodiment of the present invention.

As shown in FIG. 3, the liquid crystal display includes a liquid crystal panel assembly 300, a gate driver 400, a data driver 500, a gray voltage generator 800, and a signal controller 600.

The liquid crystal panel assembly 300 includes a plurality of signal lines (G1-Gn, D1-Dm) and a plurality of pixels PX connected to the signal lines (G1-Gn, D1-Dm) and arranged in a matrix. From the viewpoint of the configuration shown in FIG. 4, the liquid crystal panel assembly 300 includes lower and upper panels 100 and 200 facing each other and a liquid crystal layer 3 provided therebetween.

The signal lines (G1-Gn, D1-Dm) include a plurality of gate lines (G1-Gn) for transmitting a gate signal (also called a scanning signal) and a plurality of data lines (D1-Dm) for transmitting a data voltage. The gate lines (G1-Gn) extend in the row direction substantially in parallel with each other, and the data lines (D1-Dm) extend in the column direction substantially in parallel with each other.

Each pixel PX, for example, the pixel PX connected to the i-th (i=1, 2, . . . , n) gate line (Gi) and the j-th (j=1, 2, . . . , m) data line (Dj) includes a switching element Q connected to the signal lines (Gi, Dj), a liquid crystal capacitor Clc connected thereto, and a storage capacitor Cst. The storage capacitor Cst is optional and may be omitted.

The switching element Q is a three-terminal element such as a thin film transistor installed on the lower panel 100, and includes a control terminal connected to a gate line (Gi), an input terminal connected to a data line (Dj), and an output terminal connected to a liquid crystal capacitor Clc and a storage capacitor Cst. The thin film transistor may include polysilicon or amorphous silicon.

The liquid crystal capacitor Clc has a pixel electrode 191 of the lower panel 100 and a common electrode 270 of the upper panel 200 as two terminals, and the liquid crystal layer 3 between the two electrodes 191 and 270 functions as a dielectric material. The pixel electrode 191 is connected to the switching element Q, and the common electrode 270 is formed on the front surface of the upper panel 200 and receives a common voltage Vcom. As an alternative to the configuration shown in FIG. 4, the common electrode 270 can be formed on the lower panel 100, and in such case, at least one of the electrodes 191 and 270 can be formed to be in the shape of a line or a bar.

The storage capacitor Cst is formed when an additional signal line (not shown) is provided on the lower panel 100 and the pixel electrode 191 with an insulator therebetween, and a predetermined voltage such as a common voltage Vcom is applied to the signal line. However, the storage capacitor Cst can be formed when the pixel electrode 191 is overlapped on the previous gate line with the insulator as a medium.

In order to realize a color display, the pixel PX is controlled to uniquely represent one of the primary colors. According to this approach, as discussed above, a pixel may include a red subpixel, a blue subpixel, and a green subpixel. This approach is known as spatial division. Alternatively, each pixel PX may be controlled to alternately represent the primary colors with respect to time. For example, the pixel may sequentially display a red value, a blue value, and a green value. This approach is known as temporal division. In either case, the desired color may be recognized by a spatial or temporal sum of the primary colors. The primary colors include, for example, red, green, and blue. FIG. 4 shows an example of spatial division wherein each pixel PX includes a color filter 230 for displaying one of the primary colors at a region of the upper panel 200 corresponding to the pixel electrode 191. Accordingly, the three respective pixels PX for displaying red, green, and blue form a dot that displays one color. In some exemplary embodiments, however, red, green and blue pixels are arranged in a geometry other than one in which three pixels of different colors form a dot. According to one alternative approach to that shown in FIG. 4, the color filter 230 can be provided over or under the pixel electrode 191 of the lower panel 100.

At least one polarizer (not shown) for polarizing light is attached to an outer side of the liquid crystal panel assembly 300.

Referring to FIG. 3, the gray voltage generator 800 generates two pairs of gray voltage sets relating to transmittance of the pixel PX. One of the two pairs has a positive value for the common voltage Vcom and the other thereof has a negative value. A number of gray voltages included in a pair of gray voltage sets generated by the gray voltage generator 800 may be equal to a number of gray levels (e.g. pixels or subpixels) displayable by the liquid crystal display.

The data driver 500 connected to the data lines (D1-Dm) of the liquid crystal panel assembly 300 selects a gray voltage from the gray voltage generator 800 and applies the same to the data lines (D1-Dm) as a data voltage.

The gate driver 400 applies a gate signal that is a combination of a gate-on voltage Von and a gate-off voltage Voff to the gate lines (G1-Gn).

The signal controller 600 controls the gate driver 400 and the data driver 500, and includes the image signal modifying device 60 for generating a modified signal by processing input image signals R, G, and B. The image signal modifying device 60 and the image signal modifying method may be substantially the same as described above with reference to FIG. 1 and FIG. 2.

FIG. 3 shows that the image signal modifying device 60 is included in the signal controller 600, but alternatively, only a part of the image signal modifying device 60 is included in the signal controller 600. Further, the image signal modifying device 60 can be wholly separated from the signal controller 600.

The respective driving devices 400, 500, 600, and 800 can be integrated on the liquid crystal panel assembly 300 together with the signal lines (G1-Gn, D1-Dm) and the switching element Q. Alternatively, the driving devices 400, 500, 600, and 800 can be directly installed as at least one IC chip on the liquid crystal panel assembly 300, can be installed in a flexible printed circuit film (not shown) to be attached to the liquid crystal panel assembly 300 as a tape carrier package (TCP), or can be installed on an additional printed circuit board (PCB) (not shown). Also, the driving devices 400, 500, 600, and 800 can be integrated into a single chip, and at least one of them or at least one circuit element configuring them can be provided outside of the single chip.

An operation of the liquid crystal display will now be described.

The signal controller 600 receives input image signals R, G, and B and an input control signal for controlling display of the input image signals from an external graphics controller (not shown). The input image signals R, G and B have luminance information of each pixel PX. Luminance corresponds to predetermined gray levels. The input control signal may include, for example, a vertical synchronization signal Vsync, a horizontal synchronizing signal Hsync, a main clock signal MCLK, and a data enable signal DE.

The signal controller 600 generates an output image signal DAT by using the input image signals R, G, and B and the input control signal to process the same, and generates a gate control signal CONT1 and a data control signal CONT2. The signal controller 600 transmits the gate control signal CONT1 to the gate driver 400 and transmits the data control signal CONT2 and the processed output image signal DAT to the data driver 500.

The gate control signal CONT1 includes a scanning start signal STV for instructing a scan start and at least one clock signal for controlling an output period of the gate-on voltage Von. The gate control signal CONT1 may further include an output enable signal OE for controlling the duration of the gate-on voltage Von.

The data control signal CONT2 includes a horizontal synchronization start signal STH for notifying a start of transmission of the output image signal DAT for the pixels PX, a load signal LOAD for applying a data voltage to the liquid crystal panel assembly 300, and a data clock signal HCLK. Further, the data control signal CONT2 may include a reverse signal RVS for reversing a voltage polarity of the data voltage for the common voltage Vcom (hereinafter, the voltage polarity of the data signal for the common voltage may be called a polarity of the data signal).

According to the data control signal CONT2 from the signal controller 600, the data driver 500 receives a digital output image signal DAT for the pixels PX and selects a gray voltage corresponding to the digital output image signal DAT to convert the digital output image signal DAT into an analog data voltage and apply the same to the corresponding data line (D1-Dm).

The gate driver 400 turns on the switching element Q connected to the gate lines (G1-Gn) by applying the gate-on voltage Von to the gate lines (G1-Gn) according to the gate control signal CONT1 provided by the signal controller 600. The data voltage applied to the data line (D1-Dm) is applied to the corresponding pixel PX through the turned-on switching element Q.

A difference between the data voltage that is applied to the pixel PX and the common voltage Vcom is shown as a charged voltage of the liquid crystal capacitor Clc, for example, a pixel voltage. The arrangement of the liquid crystal molecules is changeable by the magnitude of the pixel voltage and the polarization of light passing through the liquid crystal layer 3 is varied. The change of polarization creates a change of transmittance of light that has passed through the polarizer attached to the display panel assembly 300, and the pixel PX displays the luminance displayed by the gray level of the image signal DAT.

The above-described process is repeated for each 1 horizontal period (which is also written as 1H and corresponds to one period of the horizontal synchronizing signal Hsync and the data enable signal DE) to sequentially apply the gate-on voltage Von to all gate lines (G1-Gn) and apply the data voltage to all pixels PX and thereby display a one-frame image.

A state of the reverse signal RVS applied to the data driver 500 is controlled, in a process known as "frame reversal," so that a new frame may begin after a frame is over and the polarity of the data voltage applied to each pixel PX may be opposite the polarity of the previous frame. In a single frame, the polarity of the data voltage flowing through a data line can be changed (e.g., row inversion or dot inversion) or the polarities of the data voltages applied to a pixel column can be different (e.g., column inversion or dot inversion) depending on the characteristic of the reverse signal RVS.

When a voltage is applied to the liquid crystal capacitor Clc, liquid crystal molecules of the liquid crystal layer 3 are arranged into a stable state that corresponds to the voltage. Reaching the stable state takes the liquid crystal a certain amount of time because the response speed of the liquid crystal molecules is relatively slow. When the voltage applied to the liquid crystal capacitor Clc is maintained, the liquid crystal molecules move until they reach the stable state, during which the light transmittance is also changed. The light transmittance becomes constant when the liquid crystal molecules have reached the stable state and no longer move.

The pixel voltage in the stable state may be called a target pixel voltage and light transmittance in this case may be called target light transmittance. The target pixel voltage and the target light transmittance may be linearly correlated.

The time provided for turning on the switching element Q of each pixel PX and applying the data voltage is limited and the liquid crystal molecules may not be able to reach the stable state while the data voltage is applied. A voltage difference at the liquid crystal capacitor Clc still exists even when the switching element Q is turned off so the liquid crystal molecules may continue to move towards the stable state. Accordingly, when the arrangement state of the liquid crystal molecules is changed, the permittivity of the liquid crystal layer 3 is changed and capacitance of the liquid crystal capacitor Clc is changed. When the switching element Q is turned off, a terminal of the liquid crystal capacitor Clc is floated, and the total charges stored in the liquid crystal capacitor Clc remain relatively stable, but for leakage current that may be present. Therefore, the change of capacitance of the liquid crystal capacitor Clc may cause a change of the voltage at the liquid crystal capacitor Clc, and accordingly, a change of the pixel voltage.

Therefore, when the data voltage (referred to as a target data voltage hereinafter) corresponding to the target pixel voltage with reference to the stable state is applied to the pixel PX, the real pixel voltage may be different from the target pixel voltage and the target transmittance might not be obtained. For example, when the difference between the target transmittance and the transmittance of the pixel PX becomes greater, the difference between the actual pixel voltage and the target pixel voltage becomes greater.

Therefore, the data voltage applied to the pixel PX can be set to be greater or less than the target data voltage, which is realizable by the DCC scheme.

In the exemplary embodiment of the present invention, the DCC scheme is performed by the image signal modifying device 60 included in the signal controller 600 or an additional image signal modifying device. The image signal modifying device modifies the current image signal [G(n)], which is an image signal of one frame for a random pixel PX based on the previous image signal [G(n−1)], and an image signal of a previous frame for the pixel PX to generate a modified signal [G'(n)], which is a modified current image signal. In this instance, the modified signal [G'(n)] is generated by using the first lookup table and the second lookup table that are separated with reference to a specific gray level of the previous image signal [G(n−1)]. The gray levels of the reference previous image signals [rG(n−1)] of the first lookup table are lower than a specific gray level, and accordingly, the gray levels of the reference previous image signals [rG(n−1)] of the first lookup table are lower than the gray levels of the second lookup table. Also, the gray gap of the reference image signals [rG(n−1), rG(n)] of the first lookup table may be larger than that of the second lookup table.

The data driver 500 converts the modified signal [G'(n)] into a data voltage and applies the data voltage to the pixel PX. By the DCC scheme, the data voltage applied to each pixel PX becomes greater than or less than the target data voltage.

The movement of the liquid crystal molecules when the gray level is changed from a bottom gray level (a low gray value) to a middle gray level (a gray value approximately halfway between minimum and maximum) is slower than that of the liquid crystal molecules when changed from the middle gray level to the bottom gray level. Therefore, the response rate of the liquid crystal is increased and the screen problem can be prevented by applying the DCC scheme by use of two lookup tables.

Figure 5:
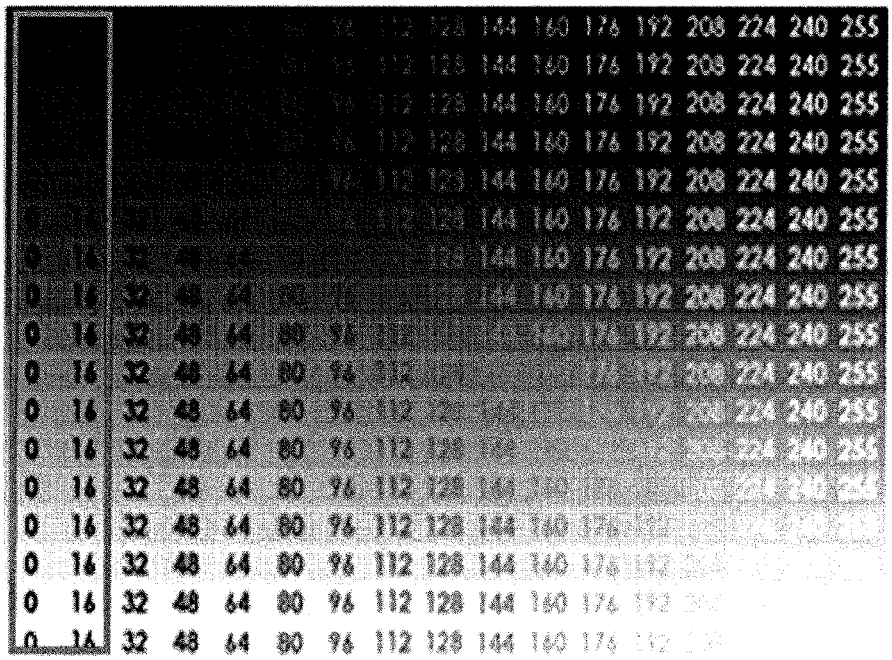
FIG. 5 is a diagram showing an example of a pattern for determining overshooting according to an exemplary embodiment of the present invention.
Figure 6:
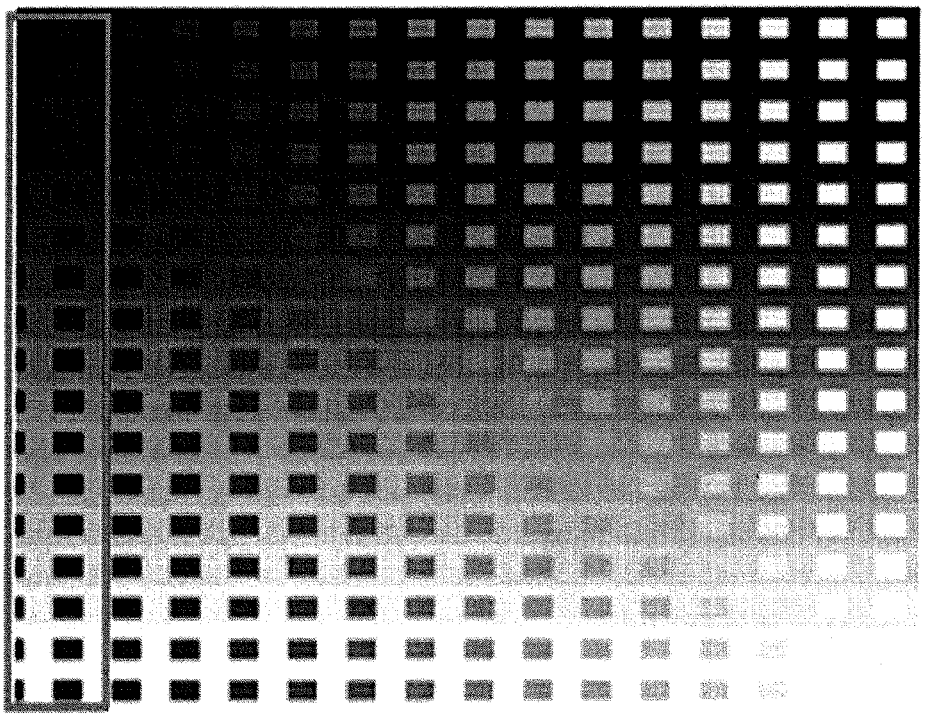
FIG. 6 is a diagram showing an example of a pattern for determining blur for each gray level according to an exemplary embodiment of the present invention.

FIG. 5 shows an example of a pattern for determining overshooting, and FIG. 6 shows an example of a pattern for determining blur for each gray level. FIG. 5 and FIG. 6 show the gray levels of an image signal from 0 to 255. There are accordingly 256 distinct gray levels. The background of the pattern is changed from the gray 0 to the gray 255 with the 16 gray gaps for each row, and the numerical figure or the rectangular shape of the pattern is changed from the gray 0 to the gray 255 with 16 gray gaps for each column. In FIG. 5, the number indicated by the numerical figure represents the gray level of the corresponding numerical figure. For example, in FIG. 5, the numerical figure of 16 signifies the gray 16. In general, when the DCC scheme is tuned, a DCC control degree is checked by using an overshoot estimating pattern and a blur estimating pattern shown in FIG. 5 and FIG. 6.

Referring to FIG. 5, the two left columns with the gray levels of the numerical figure 0 and 16 are weak in terms of overshooting. Referring to FIG. 6, the two left columns with the gray levels in the rectangular figure 0 and 16 are weak in terms of ghosting.

Accordingly, the DCC control degree for the low gray 0 and the gray 16 is clearly shown to be image degradation, and most other gray levels are not shown as large defects when they have minor errors.

Hence, when the gray level of the previous image signal [G(n−1)] is a low gray level, a bad image can be prevented by using the first lookup table with a large gray gap.

A method of using a single lookup table with the same gray gap irrespective of the gray level of the previous image signal [G(n−1)] will now be described with reference to FIG. 7 to FIG. 11. FIG. 7 to FIG. 11 show a case of using a lookup table with a gray gap of 16.

Figure 7:
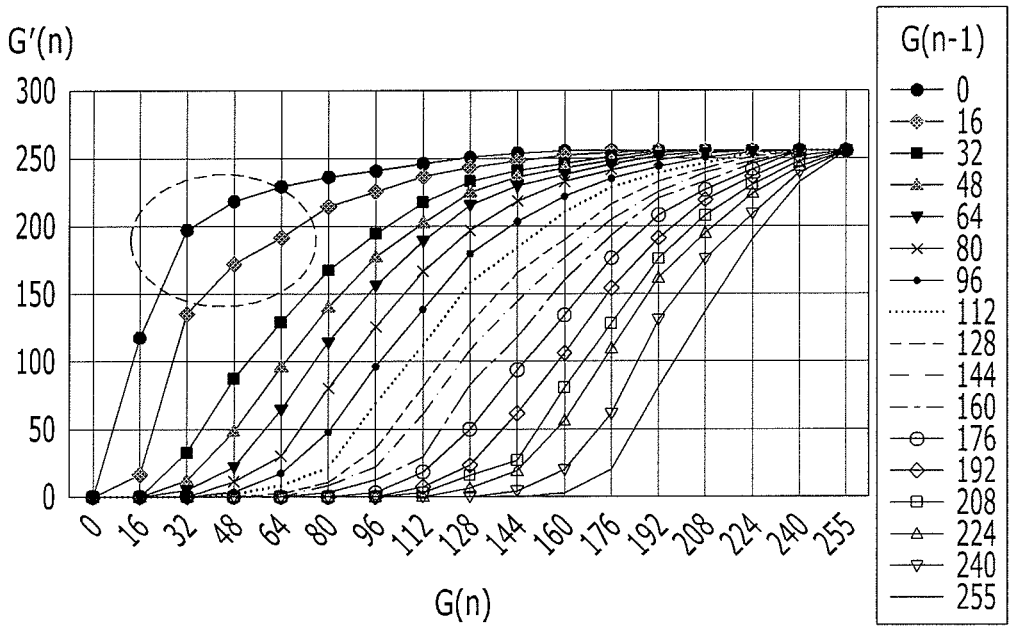
FIG. 7 is a graph of a lookup table for a liquid crystal display driven at 480 Hz according to an exemplary embodiment of the present invention.
Figure 8:
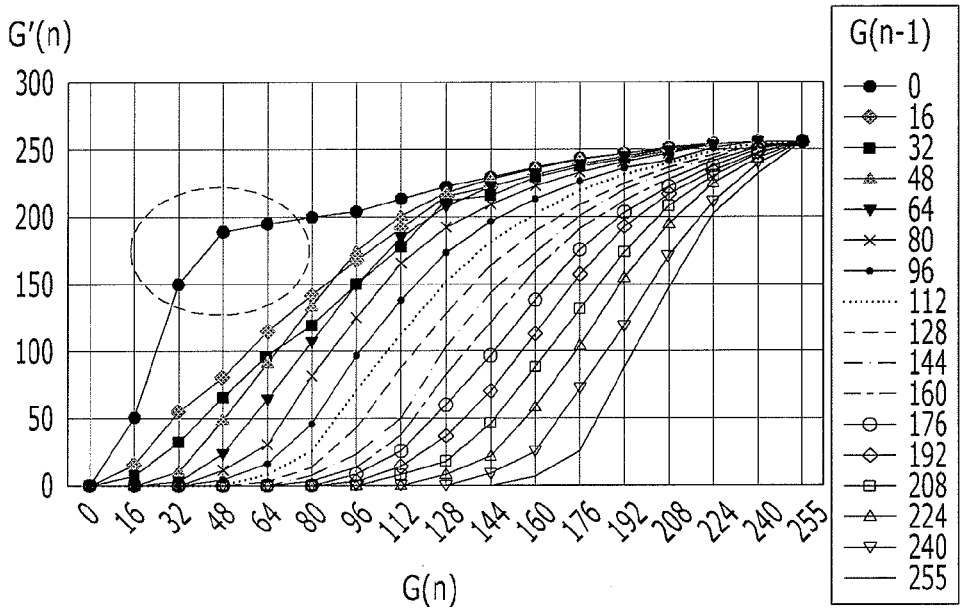
FIG. 8 is a graph of a lookup table for a liquid crystal display driven at 240 Hz according to an exemplary embodiment of the present invention.

FIG. 7 shows an exemplar graph of a lookup table for a liquid crystal display driven at 480 Hz, and FIG. 8 shows an exemplar graph of a lookup table for a liquid crystal display driven at 240 Hz.

Referring to FIG. 7 and FIG. 8, when the gray level of the previous image signal [G(n−1)] is a low gray level, the modified signal [G'(n)] of the current image signal [G(n)] is steeply changed at the low gray level.

In FIG. 7, when the gray levels of the previous image signal [G(n−1)] are 0 and 16, they are steeply increased compared to other gray levels. In FIG. 8, when the gray level of the previous image signal [G(n−1)] is 0, it is steeply increased compared to other gray levels.

Accordingly, when the gray level of the previous image signal [G(n−1)] is a specific gray level, the gray level of the modified signal [G'(n)] is set to be greater than 200 starting from the case in which the current image signal [G(n)] has a low gray level. Therefore, the modified signal [G'(n)] is saturated as the current image signal [G(n)] comes to have a higher gray level.

When the gray level of the previous image signal [G(n−1)] is greater than a specific gray level (e.g., the gray 16), the trend of the modified signal [G'(n)] is not much changed, and the modified signal [G'(n)] shows a constant characteristic. Therefore, when the gray level of the previous image signal [G(n−1)] is greater than the specific gray level, the error may be relatively reduced through the interpolation method.

When the gray level of the previous image signal [G(n−1)] is a low gray level that is below a specific gray level (e.g. a predetermined threshold), according to an exemplary embodiment of the present invention, the error caused by interpolation can be reduced by using the first lookup table with a large gray gap. Further, when the gray level of the previous image signal [G(n−1)] is greater than a specific gray level, the second lookup table with the gray gap that is greater than 16 can be used. For example, the gray gap of the second lookup table can be 32.

Figure 9:
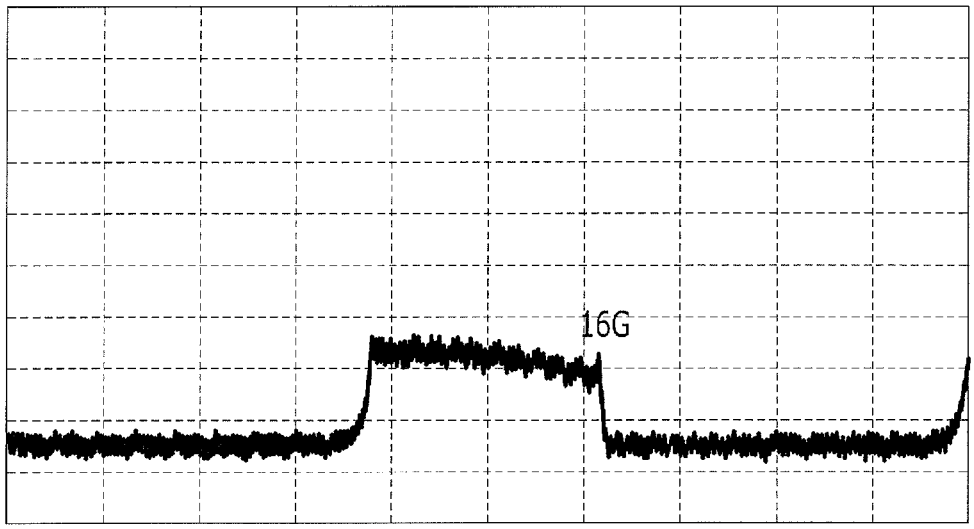
FIG. 9 to FIG. 11 are illustrations of a response waveform produced when a lookup table with a gray interval of 16 is used.
Figure 10:
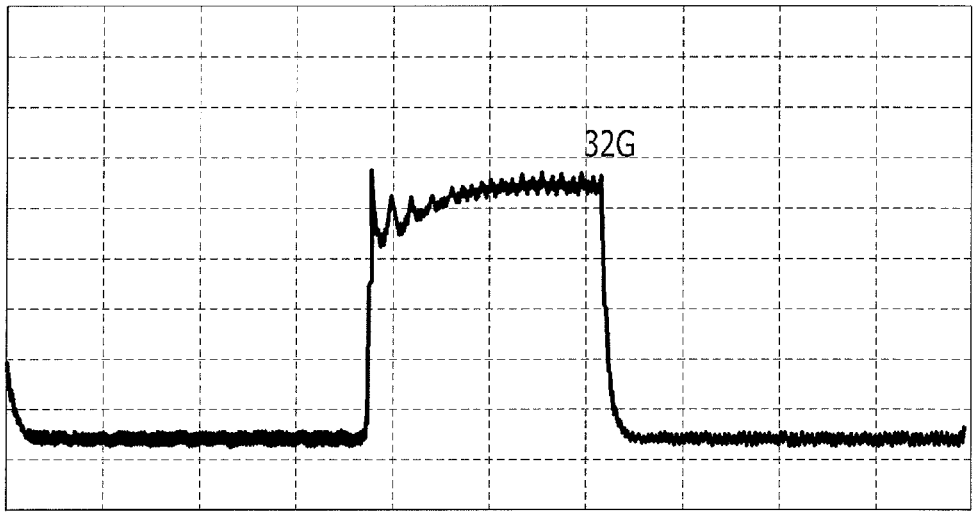
Figure 11:
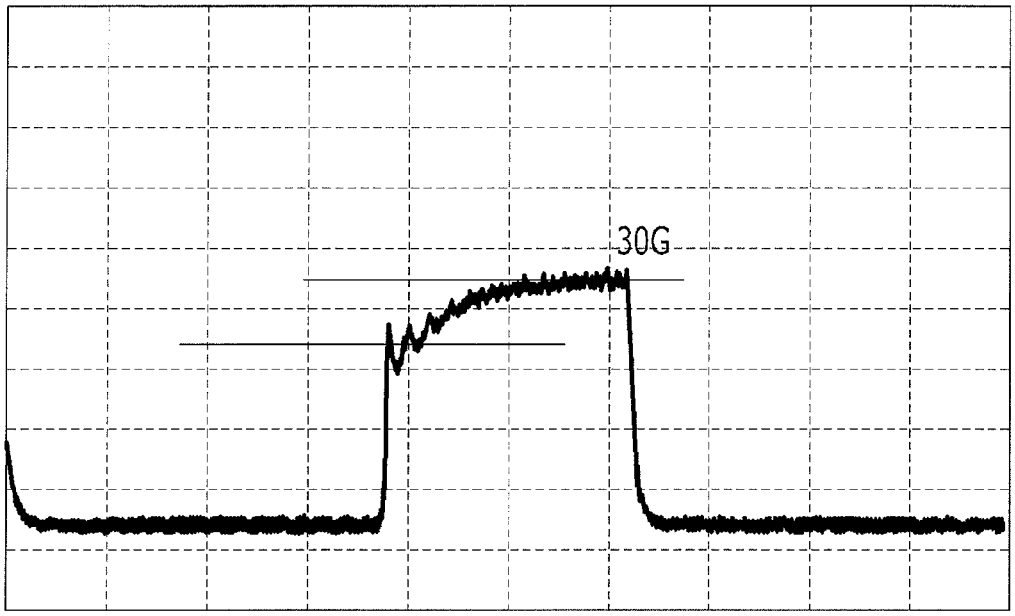

FIG. 9 to FIG. 11 show examples of a response waveform produced when a lookup table with the gray interval of 16 is used. In FIG. 9 to FIG. 11, the gray level of the previous image signal [G(n−1)] is a low gray level, for example, gray 0.

FIG. 9 shows a response waveform produced when the gray level of the current image signal [G(n)] is 16, and FIG. 10 shows a response waveform produced when the gray level of the current image signal [G(n)] is 32.

FIG. 11 shows a response waveform produced for the case of finding the modified signal [G'(n)] through interpolation based on the lookup table with the gray gap 16 when the gray level of the current image signal [G(n)] is 30.

Referring to FIG. 11, the response waveform produced of the interpolated gray 30 shows the response speed that is very much less than the target level. This case is displayed as dragging on the actual LCD screen to thereby cause image degradation.

Referring to FIG. 7 and FIG. 8, when the gray level of the previous image signal [G(n−1)] is a low gray level, the modified signal [G'(n)] may be set to be large starting from the time when the current image signal [G(n)] is a low gray level, and an excessive DCC voltage may be applied. In this case, the gray level of the modified signal [G'(n)] calculated by interpolation can substantially change the response waveform produced by a small difference and can deteriorate the image.

According to the exemplary embodiment of the present invention, the lookup tables with different gray gaps with reference to a specific (e.g. predetermined) gray level (N) of the previous image signal [G(n−1)] can be used. When the gray level of the previous image signal [G(n−1)] is a low gray level that is less than the specific gray level (N), the first lookup table with a large gray gap is applied. When the gray level of the previous image signal [G(n−1)] is greater than the specific gray level (N), the second lookup table with the gray gap that is greater than that of the first lookup table is applied. Therefore, the response speed of the liquid crystal of the liquid crystal display is increased and the bad image is prevented. For example, when the driving frequency of the liquid crystal display is great, the phenomenon of image degradation caused by the DCC voltage error in the low gray level can be reduced.

While exemplary embodiments of the present invention have been described herein, it is to be understood that the invention is not limited to the disclosed embodiments.

What is claimed is:

1. A liquid crystal display comprising:

a pixel;

an image signal modifier generating a modified signal based on a first image signal of a first frame, a second image signal of a second frame, and a lookup table; and a data driver converting the modified signal into a data voltage and supplying the data voltage to the pixel, wherein the lookup table stores a plurality of reference modified signals for a plurality of reference first image signals and a plurality of reference second image signals, and the lookup table includes:

a first lookup table in which a difference between the reference first image signals and the reference second image signals is equal to x, wherein x is a natural number; and a second lookup table in which a difference between the reference first image signals and the reference second image signals is equal to y, wherein y is a natural number greater than x, wherein the second lookup table has larger gradations between entries than does the first lookup table, wherein a gray level of the reference first image signals is less than N in the first lookup table, wherein N is a natural number, and a gray level of the reference first image signals is greater than N in the second lookup table, and wherein when the gray level of the first image signal is less than N, the image signal modifier generates the modified signal based on the first lookup table and not the second lookup table, and when the gray level of the first image signal is not less than N, the image signal modifier generates the modified signal based on the second lookup table and not the first lookup table.

2. The liquid crystal display of claim 1, wherein when the gray level of the first image signal does not match the gray level of the reference first image signals or the gray level of the second image signal does not match the gray level of the reference second image signals, the image signal modifier generates the modified signal by interpolating the lookup table.

3. The liquid crystal display of claim 2, wherein N is 17, x is greater than or equal to 3, and y is greater than 16.

4. The liquid crystal display of claim 3, wherein regarding the first lookup table, the gray level of the reference first image signals ranges from a gray level of 0 to a gray level of 16, the gray level of the reference second image signals ranges from a gray level of 0 to a gray level of 255, and of the differences between the reference first image signals and the reference second image signals are 3 or 4, and regarding the second lookup table, the gray level of the reference first image signals ranges from a gray level of 32 to a gray level of 255, the gray level of the reference second image signals ranges from a gray level of 32 to a gray level of 255, and of the differences between the reference first image signals and the reference second image signals are 31 or 32.

5. The liquid crystal display of claim 4, wherein the first lookup table stores 320 reference modified signals for the 5 reference first image signals and the 64 reference second image signals, and the second lookup table stores 64 reference modified signals for the 8 reference first image signals and the 8 reference second image signals.

6. The liquid crystal display of claim 5, further including a frame memory for storing or outputting the first image signal and the second image signal.

7. The liquid crystal display of claim 6, wherein the first frame and the second frame are consecutive, and the second frame comes after the first frame.

8. The liquid crystal display of claim 7, wherein values of the lookup table are determined in accordance with a dynamic capacitance compensation (DCC) method.

9. A method for modifying an image signal of a liquid crystal display, comprising:

receiving a first image signal and a second image signal of two proximate image frames;

generating a modified signal based on the first image signal, the second image signal, and a lookup table; and converting the modified signal into a data voltage and supplying the data voltage to a pixel of the liquid crystal display, wherein generating the modified signal based on the lookup table includes reading reference modified signals by looking up given reference first image signals and reference second image signals, and looking up given reference first image signals includes:

referencing a first lookup table in which a difference between the reference first image signals and the reference second image signals is equal to x, wherein x is a natural number; and referencing a second lookup table in which a difference between the reference first image signals and the reference second image signals is equal to y, wherein y is a natural number greater than x, wherein the second lookup table has larger gradations between entries than does the first lookup table, and wherein the generating the modified signal based on the lookup table further includes:

determining whether a gray level of the first image signal is less than N, wherein N is a natural number;

generating the modified signal based on the first lookup table and not the second lookup table when it is determined that the gray level of the first image signal is less than N;

generating the modified signal based on the second lookup table and not the first lookup table when it is determined that the gray level of the first image signal is not less than N.

10. The method of claim 9, wherein the generating of a modified signal further includes, when the gray level of the first image signal does not correspond to a gray level of the reference first image signals or a gray level of the second image signal does not correspond to a gray level of the reference second image signals, generating the modified signal by interpolating the lookup table.

11. The method of claim 10, wherein N is 17, x is greater than or equal to 3, and y is greater than 31.

12. A device for modifying an image signal of a liquid crystal display, comprising:

a lookup table storing a plurality of reference modified signal for a plurality of reference first image signals and a plurality of reference second image signals; and an image signal modifier receiving a first image signal of a first frame and a second image signal of a second frame subsequent to and proximate to the first frame, and generating a modified signal based on the first image signal, the second image signal, and the lookup table, wherein the lookup table comprises:

a first lookup table in which a difference between the reference first image signals and the reference second image signals is equal to x, wherein x is a natural number; and a second lookup table in which a difference between the reference first image signals and the reference second image signals is equal to y, wherein y is a natural number greater than x, wherein the second lookup table has larger gradations between entries than does the first lookup table, and wherein a gray level of the reference first image signals is less than N in the first lookup table, wherein N is a natural number, and a gray level of the reference first image signals is greater than N in the second lookup table, and wherein when the gray level of the first image signal is less than N, the image signal modifier generates the modified signal based on the first lookup table and not the second lookup table, and when the gray level of the first image signal is not less than N, the image signal modifier generates the modified signal based on the second lookup table and not the first lookup table.

13. The device of claim 12, wherein when the gray level of the first image signal does not match the gray level of the reference first image signals or the gray level of the second image signal does not match the gray level of the reference second image signals, the image signal modifier generates the modified signal by interpolating the lookup table.

14. A liquid crystal display, comprising:

an image signal modifier generating a modified signal based on a first image signal of a first frame, a second image signal of a second frame, and a lookup table determined in accordance with a dynamic capacitance compensation (DCC) method; and a data driver converting the modified signal into a data voltage and supplying the data voltage to the liquid crystal display, wherein the lookup table includes:

a first lookup table in which a difference between the reference first image signals and the reference second image signals is equal to a first predetermined number; and a second lookup table in which a difference between the reference first image signals and the reference second image signals is equal to a second predetermined number greater than the first predetermined number, wherein the second lookup table has larger gradations between entries than does the first lookup table, wherein a gray level of the reference first image signals is less than N in the first lookup table, wherein N is a natural number, and a gray level of the reference first image signals is greater than N in the second lookup table, and wherein when the gray level of the first image signal is less than N, the image signal modifier generates the modified signal based on the first lookup table and not the second lookup table, and when the gray level of the first image signal is not less than N, the image signal modifier generates the modified signal based on the second lookup table and not the first lookup table.

15. The device of claim 13, wherein values of the lookup table are determined in accordance with a dynamic capacitance compensation (DCC) method.

* * * * *